US007049915B2

(12) United States Patent
Delamare et al.

(10) Patent No.: US 7,049,915 B2
(45) Date of Patent: May 23, 2006

(54) BISTABLE MAGNETIC ACTUATOR

(75) Inventors: Jérôme Delamare, Grenoble (FR); Claire Divoux, Grenoble (FR); Pierre Gaud, Coubuevie (FR); Frédéric Lepoitevin, Conde sur Vire (FR)

(73) Assignee: Commissariat a l'Energie Atomique, Paris (FR)

( * ) Notice: Subject to any disclaimer, the term of this patent is extended or adjusted under 35 U.S.C. 154(b) by 139 days.

(21) Appl. No.: 10/476,163

(22) PCT Filed: Apr. 29, 2002

(86) PCT No.: PCT/FR02/01487

§ 371 (c)(1),
(2), (4) Date: Oct. 24, 2003

(87) PCT Pub. No.: WO02/091402

PCT Pub. Date: Nov. 14, 2002

(65) Prior Publication Data

US 2004/0113732 A1 Jun. 17, 2004

(30) Foreign Application Priority Data

May 3, 2001 (FR) ..... 01 05909

(51) Int. Cl.
*H01F 7/08* (2006.01)

(52) U.S. Cl. ..... 335/220; 335/177

(58) Field of Classification Search ..... 335/78, 335/128, 177–179, 220–229
See application file for complete search history.

(56) References Cited

U.S. PATENT DOCUMENTS

| | | | | |
|---|---|---|---|---|
| 3,858,135 | A * | 12/1974 | Gray | 335/266 |
| 5,724,015 | A | 3/1998 | Tai et al. | |
| 5,818,131 | A | 10/1998 | Zhang | |
| 6,054,329 | A * | 4/2000 | Burghartz et al. | 438/3 |
| 6,674,350 | B1 * | 1/2004 | Hirose et al. | 335/256 |
| 6,803,843 | B1 * | 10/2004 | Kato et al. | 335/78 |
| 6,859,122 | B1 * | 2/2005 | Divoux et al. | 335/78 |

FOREIGN PATENT DOCUMENTS

| | | |
|---|---|---|
| DE | 197 14 413 A1 | 10/1998 |
| EP | 1 081 722 A | 3/2001 |
| WO | 97/39468 | 10/1997 |
| WO | 98/42959 | 10/1998 |

OTHER PUBLICATIONS

Ren et al., M. Sc. H. "A Bistable Microfabricated Magnetic Cantilever Microactuator with Permanent Magnet" 5th International Conference on Micro Electro, Opto, Mechanical Systems and Components 96, Potsdam 17-19, Sep. 1996, pp. 799-801.

* cited by examiner

*Primary Examiner*—Bernard Rojas
(74) *Attorney, Agent, or Firm*—Hutchison Law Group PLLC

(57) ABSTRACT

An actuator is described having two fixed magnetic structures, and a mobile magnetic part able to move towards either one of the two ends of the magnetic structures. The actuator can be in the form of a microactuator, and can be used in the fabrication of microrelays, microvalves, and micropumps.

8 Claims, 6 Drawing Sheets

BISTABLE MAGNETIC ACTUATOR

RELATED APPLICATIONS

This application is a National Stage application of International Application No. PCT/FR02/01487, titled "Bistable Magnetic Actuator", and filed on Apr. 29, 2002, and claims priority under 35 U.S.C. § 119 (a)–(d) and/or § 365(b) to French Patent Application No. 01 05909, filed on May 3, 2001, the entire contents of which are hereby incorporated by reference.

TECHNICAL FIELD

The subject of the present invention is a bistable magnetic actuator, in particular a microactuator. It finds application in the fabrication of microrelays (electric or optic), microvalves, micropumps, etc.

PRIOR ART

Document WO 97/39468 describes a magnetic actuator able to assume the form illustrated in appended FIG. 1. Such as shown, this actuator comprises a magnetic circuit consisting of a central polar part 12 surrounded by a conductor coil 14 and by two symmetrical polar parts 16. A mobile magnetic part 18 is arranged opposite the central polar part 12.

When a current circulates in coil 14, a magnetic force F acts on the mobile magnetic part 18 driving this part up against a fixed conductor part 19. This contact closes an electric circuit (not shown).

This type of actuator is unidirectional in the sense that force F exerted on the mobile part can only be directed in a single direction. This actuator is therefore not bistable but monostable, the only stable working position being the one in which mobile part 18 lies up against contact 19.

Bistable magnetic actuators are known however. The article by M. Sc. H. Ren et al entitled "A Bistable Microfabricated Magnetic Cantilever Microactuator with Permanent Magnet" published in Reports of the 5$^{th}$ International Conference on Microsystem Technologies 96, Potsdam 17–19 September 1996, pages 799 to 801 describes an actuator shown in appended FIG. 2. This actuator comprises a permanent magnet 20 extended by two magnetic branches 22, 24, each surrounded by a conductor coil, 23, 25 respectively. A flexible beam 26 in magnetic material completes the magnetic circuit. The circuit therefore has two air gaps defined by the end of beam 26 and each of the ends of branches 22 and 24. The magnetic flow present in each of these air gaps results from the sum of the flows due to the permanent magnet 20 and to currents which may be circulating in either one of coils 23 and 25.

Magnetic forces F1 and F2 applied to the end of beam 26 are exerted either in one direction or in the other direction depending on whether a current is passing through conductor coil 23 or 25. Said actuator is therefore bi-directional or, if preferred, bistable.

This bistable actuator has a disadvantage. Since mobile part 26 forms an integral part of the magnetic circuit, its movement is limited. In addition, it has reduced mobility, its mobility arising through flexion of a magnetic part.

The purpose of the present invention is precisely to overcome this disadvantage.

DISCLOSURE OF THE INVENTION

The invention puts forward a bistable actuator in which the movement of the mobile part is increased and its mobility improved. This purpose is achieved through the fact the mobile part is fixed to flexible means which no longer form part of the magnetic circuit.

More precisely, the subject of the invention is a bistable magnetic actuator comprising:

- a first fixed magnetic structure comprising a first conductor coil surrounding a first open magnetic circuit having a first end and a second end,
- a second fixed magnetic structure comprising a second conductor coil surrounding a second open magnetic circuit having a first end and a second end, the first ends of the first and second magnetic circuits being arranged opposite one another,
- a mobile magnetic part able to occupy a first or a second stable working position depending on whether the first or second conductor coil is excited,
- for each magnetic circuit, the first end and the second end have faces positioned along planes perpendicular to one another, and the second ends of the first and second magnetic circuits have faces arranged along one same plane or which merge, characterized in that:
- the mobile magnetic part is positioned in the vicinity of the first end of the first magnetic circuit and of the first end of the second magnetic circuit,
- the mobile magnetic part is fixed to non-magnetic means allowing movement of the mobile part in the direction of the first end of the first magnetic circuit or in the direction of the first end of the second magnetic circuit.

The conductor coils and the magnetic circuits may be fabricated using techniques taken from microelectronics. The actuator is then a microactuator.

The coils may consist of layers of conductor tapes arranged in etched chambers. The magnetic circuit may be made using layers of "soft" or "hard" magnetic materials or hysteresis materials. Soft materials magnetize linear fashion in relation to the magnetic field applied to them (iron, nickel, iron-nickel, iron-cobalt, iron-silicon, . . . ) Hard materials have fixed magnetization irrespective of the applied field (ferrite, samarium-cobalt, neodymium-iron-boron, platinum-cobalt). Hysteresis materials have properties lying between those of soft materials and those of hard materials. They can magnetize and maintain magnetization when the excitation field ceases to be applied.

The two magnetic structures may assume various forms and may be symmetrical, for example relative to a plane or relative to a point.

Regarding movement of the mobile part, this movement may be translational (or quasi-translational) or rotational.

SHORT DESCRIPTION OF THE DRAWINGS

FIG. 1, already described, illustrates a monostable actuator of the prior art;

FIG. 2, already described, illustrates a bistable actuator of the prior art;

DESCRIPTION OF PARTICULAR EMBODIMENTS

The following description relates to a microactuator, but modifying the described examples to obtain an actuator would not go beyond the scope of the invention.

Figure 1:
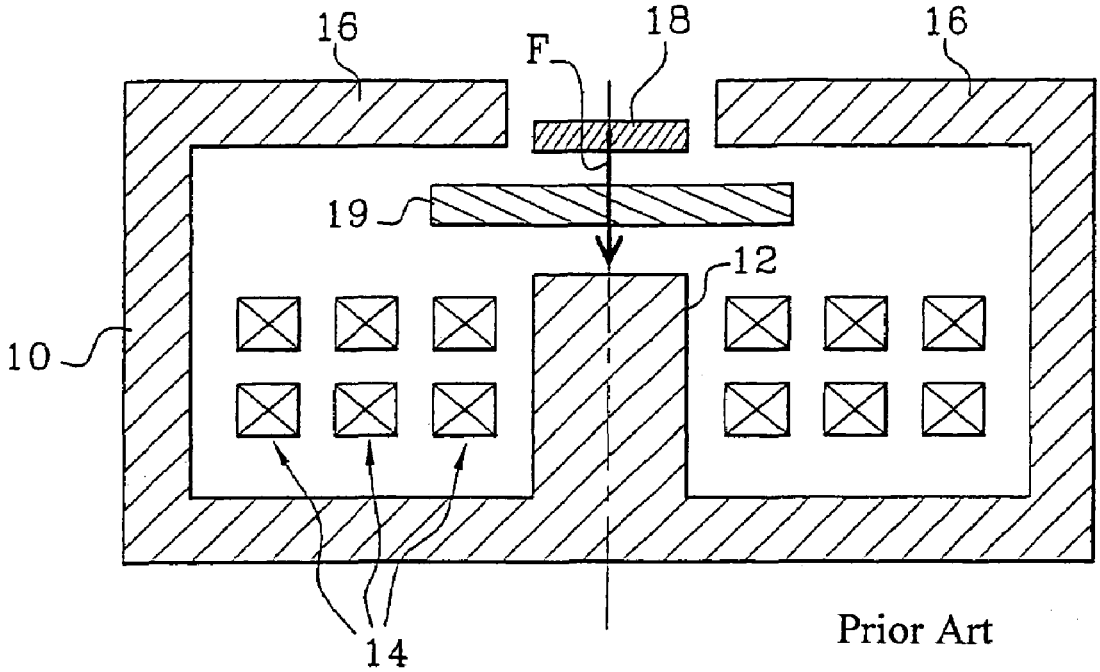
Figure 2:
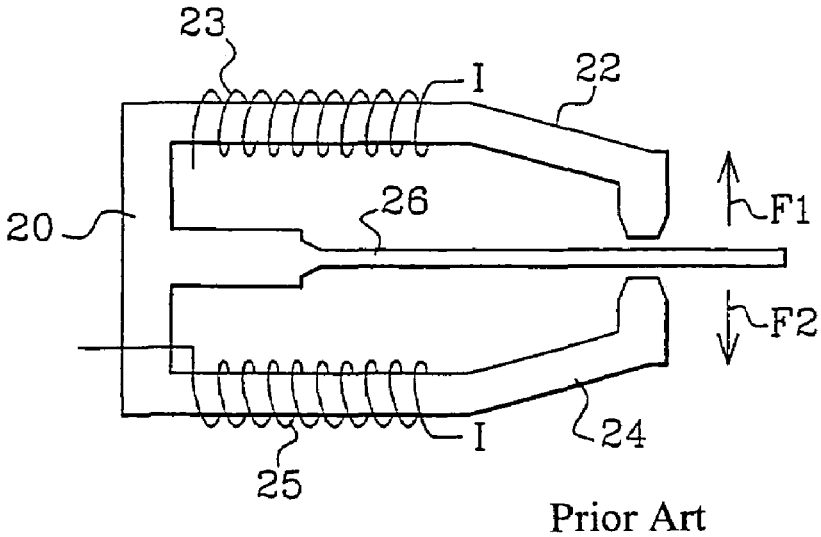
Figure 3:
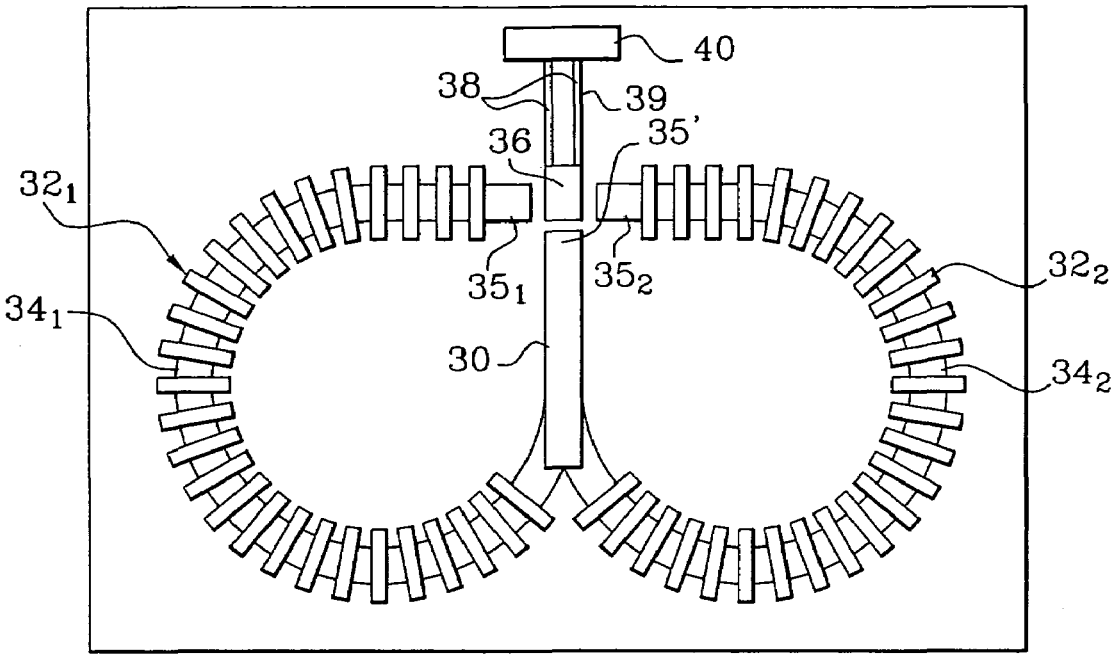
FIG. 3 illustrates a particular embodiment of a bistable microactuator of the invention.

The embodiment illustrated in FIG. 3 corresponds to a device having a symmetrical plane. The first magnetic structure comprises a first conductor coil $\mathbf{32}_1$, surrounding a first open magnetic circuit comprising a circular part $\mathbf{34}_1$, and a straight part 30 positioned along the symmetrical plane. The second structure similarly comprises a second conductor coil $\mathbf{32}_2$ surrounding a second open magnetic circuit comprising a circular part $\mathbf{34}_2$ and straight part 30 already cited which is therefore common to both structures.

The first magnetic structure has a first end $\mathbf{35}_1$, with a face perpendicular to the plane of the figure, and the second magnetic structure has a first end $\mathbf{35}_2$ with a face perpendicular to the plane of the figure. These two structures have second ends which, in the illustrated example, merge with end 35' of straight part 30. The face of this second end is perpendicular to the plane of the faces of the first ends.

The circular shapes of parts $\mathbf{34}_1$, and $\mathbf{34}_2$ are evidently solely examples, and rectangular or other shaped circuits may be chosen while remaining within the scope of the invention.

The device is completed by a mobile magnetic part 36 placed between the first ends $\mathbf{35}_1$, and $\mathbf{35}_2$ of the first and second magnetic circuits and the second merged ends 35' of these circuits. This part 36 is fixed to two flexible non-magnetic beams 38 and 39 embedded in a base 40. Naturally only one beam may be used or more than two.

The functioning of this device is as follows. Such as shown in FIG. 3, the microactuator is at rest. When a current passes through the left coil $\mathbf{32}_2$, the left magnetic circuit $\mathbf{34}_1$, is excited and mobile part 36 is drawn towards the left. It then closes the left air gap which it formed with the first magnetic circuit. When a current passes through the right coil $\mathbf{32}_2$, it is the right magnetic circuit $\mathbf{34}_2$ which is excited and the mobile part is drawn towards the right. It then closes the right air gap which it formed with the second magnetic circuit.

The described microactuator therefore truly has two stable working positions. Depending upon the composition of the materials of the magnetic coils, the mobile part is able to maintain either one of these positions even if the supply to the coils is interrupted (as is the case with hysteresis materials). But the mobile part can also resume its resting position (as is the case with soft materials). For hysteresis materials, the magnetic circuit must be de-magnetized by applying the appropriate coil with a current in the right direction so that the mobile part resumes its initial position.

FIGS. 4A to 4I illustrate a process for fabricating a microactuator according to the present invention. In a substrate 50, in silicon for example (FIG. 4A), chambers are etched which are filled with conductor material to obtain a layer of conductors 52 located on a first level; the assembly is planarized; an insulating layer 54 is deposited on which an insulating layer 56 is formed (in $SiO_2$ for example), a so-called sacrificial layer.

Figure 4A:
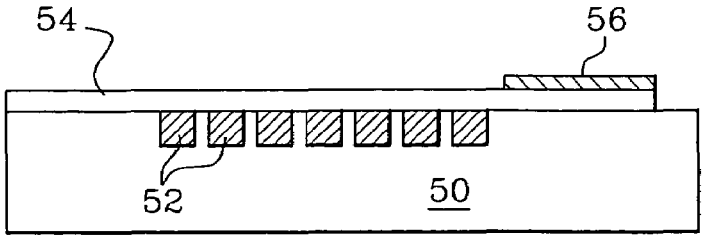
FIGS. 4A to 4I show different steps in the fabrication process of the microactuator of the invention.
Figure 4B:
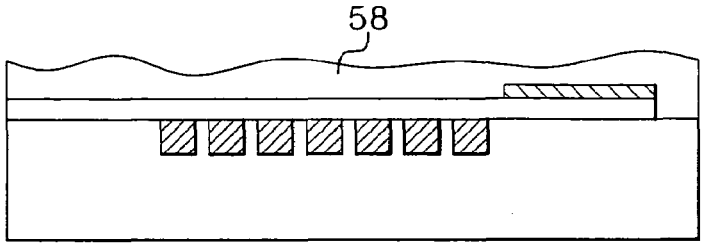
Figure 4C:
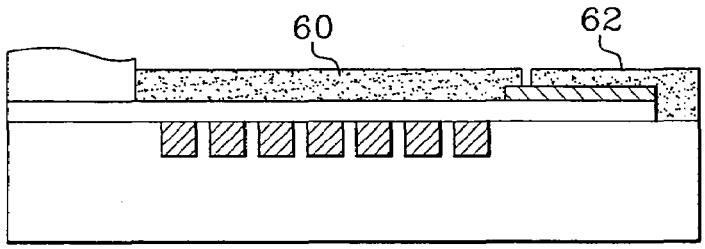
Figure 4D:
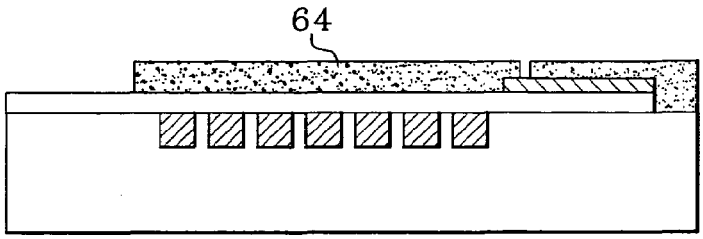
Figure 4E:
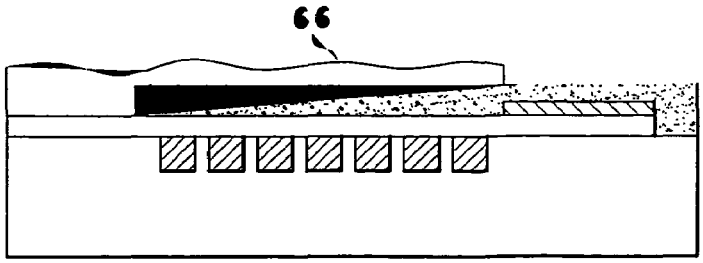

Subsequently (FIG. 4B) a layer of resin 58 is deposited. In this resin layer, a layer of magnetic material is deposited (FIG. 4C) to form the magnetic circuit 60 and the future mobile part 62; the patterns are then insulated (FIG. 4D).

Figure 4F:
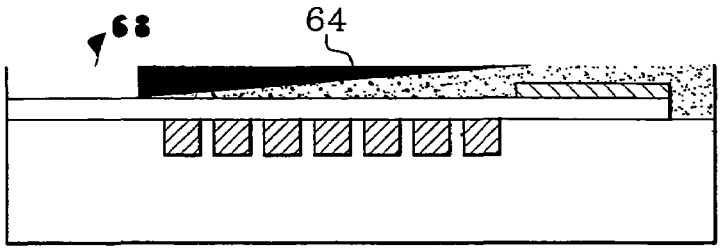
Figure 4G:
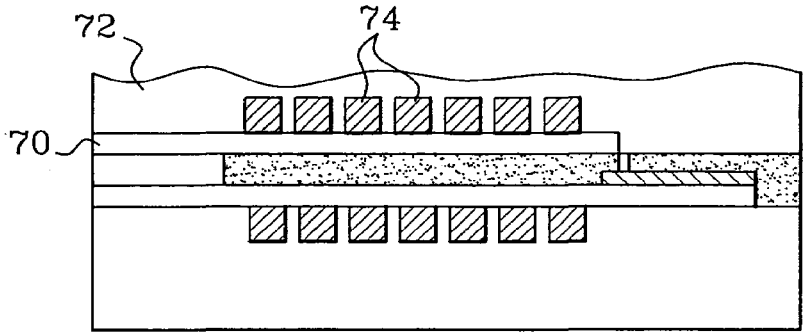
Figure 4H:
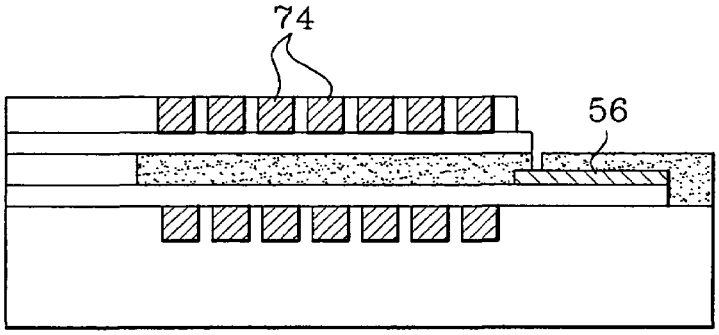
Figure 4I:
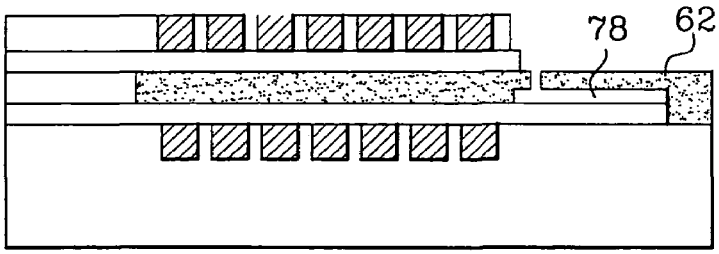

A further layer of resin 66 is then deposited (FIG. 4E) and the assembly planarized (FIG. 4F).

An insulating layer 70 (FIG. 4G) and a resin layer are then deposited; in the latter new chambers are etched which are filled with conductor material to obtain a second layer of conductors 74 on a second level. Connections (not shown) join together the two layers of conductors to obtain a coil surrounding the magnetic part.

The assembly is planarized (FIG. 4H) and the different patterns are insulated.

The sacrificial layer 56 is then etched (FIG. 4I) to clear a free space 78 and release mobile part 62.

Figure 5:
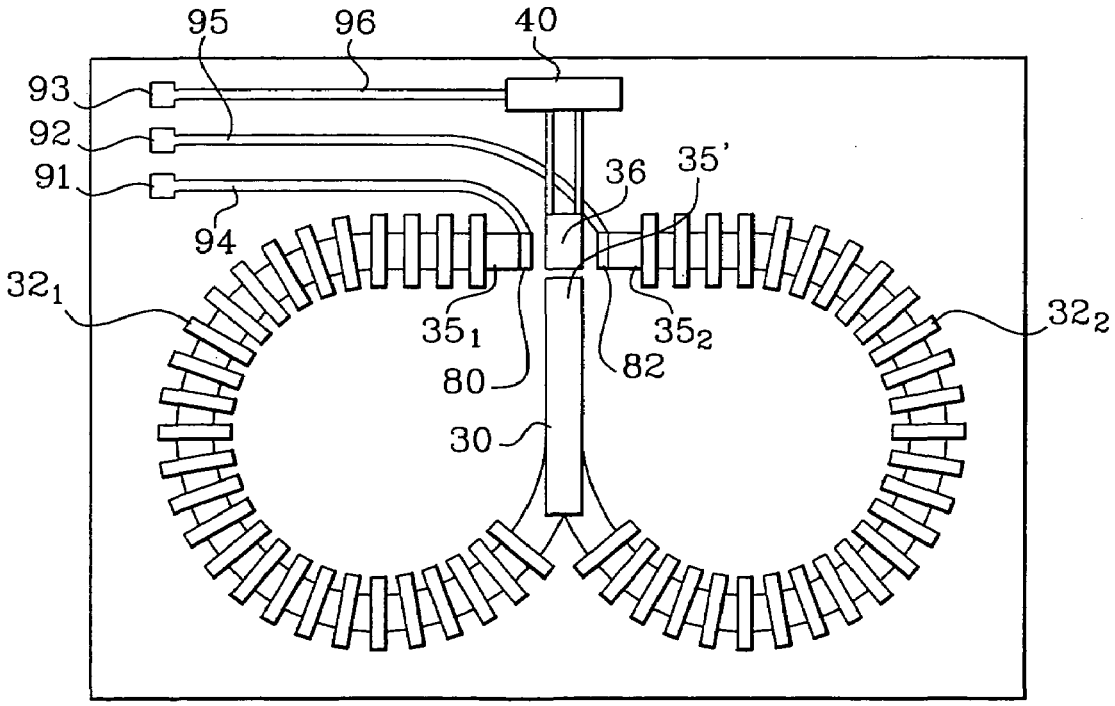
FIG. 5 illustrates application to microrelay fabrication.

FIG. 5 illustrates an application of the invention to the embodiment of an electric microrelay. This device comprises means already shown in FIG. 4 which carry these same references. It also comprises electric contacts 80 and 82 arranged on the surfaces of the first ends $\mathbf{35}_1$, and $\mathbf{35}_2$ of the magnetic circuits, three contact pads 91, 92, 93 and three pathways 94, 95, 96 connecting the pads to contacts 80 and 82 and to base 40. The second ends of the two magnetic circuits, as in the preceding example, merge with end 35' of common part 30.

When a current passes through the left coil $\mathbf{32}_1$, mobile part 36 is drawn towards the left and closes electric circuit 91, 93. When the right coil $\mathbf{32}_2$ receives a current, the mobile part is drawn towards the right and closes electric circuit 92, 93.

The electric contacts are only schematised in FIG. 5. In fact, the pathways allow the contact pads to be moved towards the periphery of the microrelay which may also house contacts to command the actuator.

Figure 6:
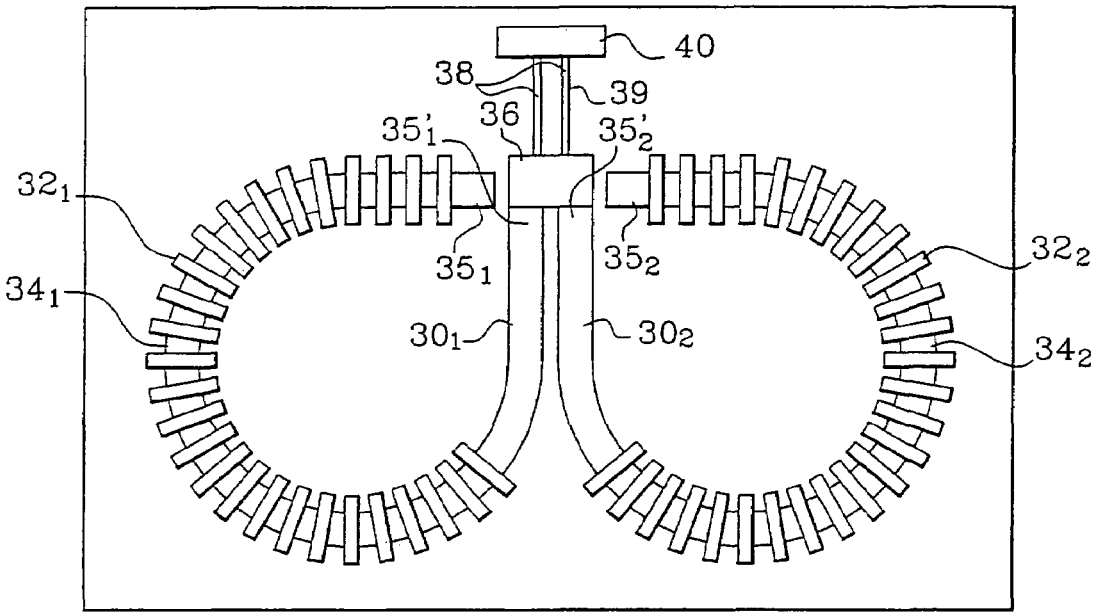
FIG. 6 illustrates another embodiment.

FIG. 6 illustrates another embodiment of a microactuator according to the invention in which the central branches of the magnetic circuits do not merge into a single branch 30, as in FIG. 3, but consist of two independent branches $\mathbf{30}_1$, $\mathbf{30}_2$ with second ends $\mathbf{35'}_1$ and $\mathbf{35'}_2$ whose faces lie along planes parallel to one another and perpendicular to the planes of the faces of the first ends $\mathbf{35}_1$ and $\mathbf{35}_2$. Magnetic leakage is therefore reduced.

Figure 7:
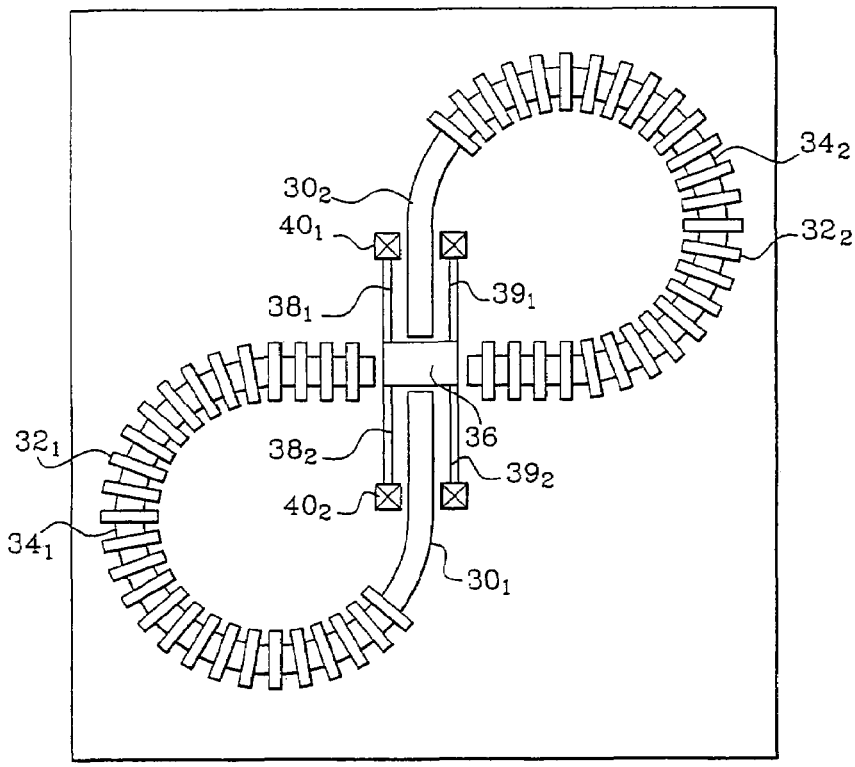
FIG. 7 illustrates a further embodiment with centre of symmetry.

FIG. 7 illustrates en embodiment with central symmetry. In other words, the two structures ($\mathbf{30}_1$, $\mathbf{32}_1$, $\mathbf{34}_1$) ($\mathbf{30}_2$, $\mathbf{32}_2$, $\mathbf{34}_2$) are symmetrical relative to a point which is the centre of the device. Mobile part 36 can then also be connected symmetric fashion to two bases $\mathbf{40}_1$, $\mathbf{40}_2$ via two sets of two flexible beams ($\mathbf{38}_1$, $\mathbf{39}_1$) ($\mathbf{38}_2$, $\mathbf{39}_2$).

Figure 8:
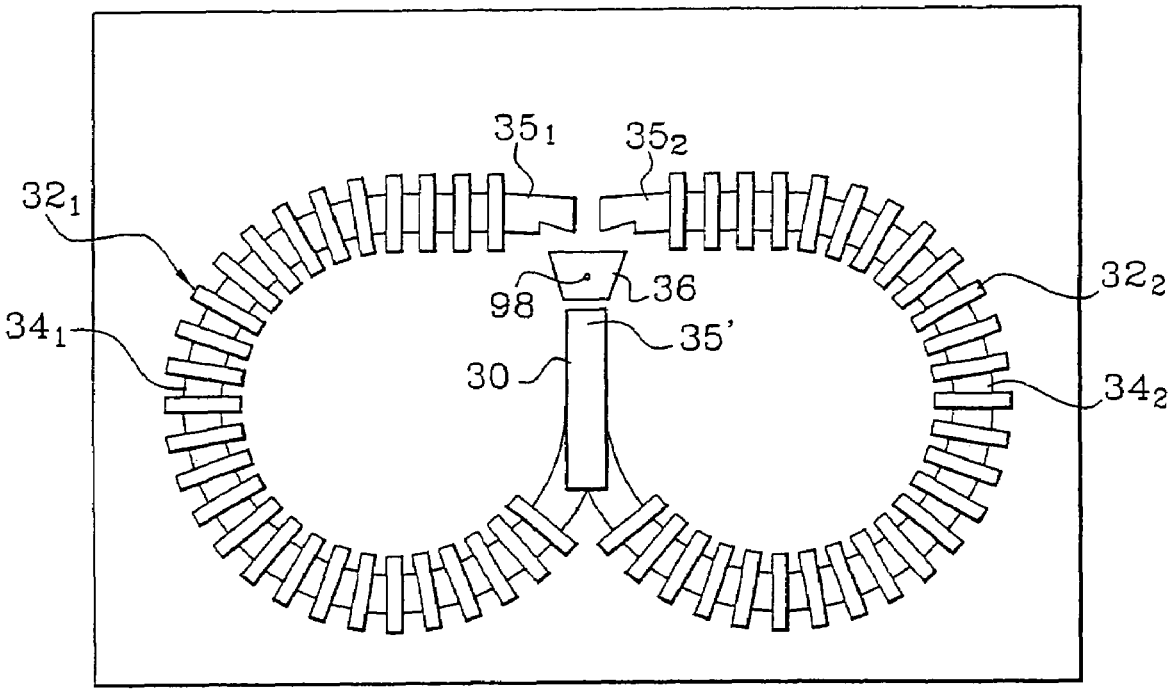
FIG. 8 illustrates a microactuator with rotational axis.

Finally, FIG. 8 shows an embodiment in which the mobile magnetic part 36 is rotationally mobile around an axis 98. It can come to rest either under end $\mathbf{35}_1$ or under end $\mathbf{35}_2$ of the two magnetic circuits $\mathbf{34}_1$ and $\mathbf{34}_2$ depending on whether the current passes through coil $\mathbf{32}_1$ or coil $\mathbf{32}_2$.

The invention claimed is:

1. A bistable magnetic actuator, comprising:

a first fixed magnetic structure including a first conductor coil surrounding a first open magnetic circuit having a first end and a second end;

a second fixed magnetic structure including a second conductor coil surrounding a second open magnetic circuit having a first end and a second end, the first ends of the first and second magnetic circuits being arranged opposite one another; and a mobile magnetic part located near the first end of the first magnetic circuit and the first end of the second magnetic circuit, the mobile magnetic part being fixed to non-magnetic means allowing movement of mobile magnetic part in the direction of the first end of the first magnetic circuit or in the direction of the first end of the second magnetic circuit, and being capable of occupying a first or a second stable working position depending on whether the first or second conductor coil is excited;

wherein for each magnetic circuit, the first end and the second end have faces positioned along planes perpendicular to one another, and the second ends of the first and second magnetic circuits have faces arranged along one same plane or which merge.

2. The actuator according to claim 1, wherein the first and second magnetic structures are arranged symmetrically to one another relative to a plane.

3. The actuator according to claim 2, wherein the means to which the mobile magnetic part is fixed comprise at least one flexible non-magnetic beam.

4. The actuator according to claim 2, wherein the first and second magnetic circuits have a common magnetic branch positioned along the plane of symmetry.

5. The actuator according to claim 1, wherein the first and second magnetic structures are arranged symmetrically relative to a point.

6. The actuator according to claim 5, wherein the means to which the mobile magnetic part is fixed comprise at least two flexible symmetrical beams.

7. The actuator according to claim 1, wherein the mobile magnetic part is rotationally mobile about an axis.

8. The actuator according to claim 1, wherein the conductor coils and the magnetic circuits are made in materials deposited in layers, the actuator being a microactuator.

* * * * *